US009200634B2

(12) United States Patent
Amir

(10) Patent No.: US 9,200,634 B2
(45) Date of Patent: Dec. 1, 2015

(54) APPARATUS FOR MAINTAINING THE OPERATION OF A GEOTHERMAL PRODUCTION PUMP

(75) Inventor: Nadav Amir, Rehovot (IL)

(73) Assignee: Ormat Technologies Inc., Reno, NV (US)

( * ) Notice: Subject to any disclaimer, the term of this patent is extended or adjusted under 35 U.S.C. 154(b) by 708 days.

(21) Appl. No.: 13/608,280

(22) Filed: Sep. 10, 2012

(65) Prior Publication Data

US 2014/0072416 A1 Mar. 13, 2014

(51) Int. Cl.

| | |
|---|---|
| ***F01D 11/00*** | (2006.01) |
| ***F04D 13/10*** | (2006.01) |
| ***F04D 29/047*** | (2006.01) |
| ***F04D 29/06*** | (2006.01) |
| ***E21B 43/12*** | (2006.01) |

(52) U.S. Cl.
CPC ..... *F04D 13/10* (2013.01); *E21B 43/126* (2013.01); *F04D 29/0476* (2013.01); *F04D 29/061* (2013.01)

(58) Field of Classification Search
CPC ... F04D 13/10; F04D 29/0476; F04D 29/061; E21B 43/126
See application file for complete search history.

(56) References Cited

U.S. PATENT DOCUMENTS

| | | | | |
|---|---|---|---|---|
| 2,001,172 | A * | 5/1935 | Wintroath | 417/414 |
| 2,082,996 | A * | 6/1937 | Wintroath | 415/146 |
| 5,634,515 | A | 6/1997 | Lambert | |
| 8,113,765 | B2 * | 2/2012 | Sullivan | 415/110 |
| 2009/0169358 | A1 | 7/2009 | Sullivan | |
| 2009/0272129 | A1 | 11/2009 | Petty | |
| 2010/0065302 | A1 * | 3/2010 | Nesbitt | 174/116 |

OTHER PUBLICATIONS

International Search Report issued Mar. 27, 2014 in PCT/IB2013/001942.

* cited by examiner

*Primary Examiner* — Dwayne J White
*Assistant Examiner* — Jason Fountain
(74) *Attorney, Agent, or Firm* — Oblon, McClelland, Maier & Neustadt, L.L.P.

(57) ABSTRACT

An apparatus for maintaining the operation of a geothermal production pump having one or more impellers and a vertical line shaft for driving the impellers, includes a liquid buffer for isolating a discharge column through which pumped geothermal fluid including non-condensable gases flows from a lubrication column through which flows oil for lubricating one or more bearings of the line shaft, the liquid buffer being interposed between the discharge column and an outlet of the lubrication column to prevent infiltration of the non-condensable gases into the lubrication column. The liquid buffer includes an upper oil receiving section facing the lubrication column outlet and a lower securing element related to the upper oil receiving section. A lowermost bearing is a thrust bearing, and a bowl in which the cup structure and the thrust bearing are housed is in fluid communication with a further bowl in which is housed an uppermost impeller.

9 Claims, 3 Drawing Sheets

GEOTHERMAL PRODUCTION PUMP
GAS SEPARATION STAGE

TOP POSITION

BOTTOM POSITION

A - A

CROSS-SECTION

APPARATUS FOR MAINTAINING THE OPERATION OF A GEOTHERMAL PRODUCTION PUMP

FIELD OF THE INVENTION

The present invention relates to the field of downhole pumps. More particularly, the invention relates to apparatus for maintaining the operation of a geothermal production pump.

BACKGROUND

A geothermal production pump is used to extract geothermal fluid from a deep well. A typical downhole geothermal production pump is a vertical turbine pump which has three main parts: the head assembly which comprises the motor for driving the pump, the shaft and column assembly, and the pump bowl assembly. The lower pump bowl assembly comprises the stationary bowl and the impeller which rotates within the bowl for enhancing the flow of the fluid to be extracted. The shaft and column assembly provides the connection between the head assembly and the pump bowl assembly. The line shaft transmits torque from the pump motor to the impellers and rotates internally to the column. The extracted fluid is transported within the discharge column to the surface.

Due to the high temperature and pressure of the geothermal fluid, a bearing mounted on the line shaft is subjected to considerable wear. To prevent excessive wear to the bearing mounted on the line shaft, the line shaft rotates within a lubrication column through which oil flows. However, the line shaft and bearings are prone to damage as a result of the intrusion of the high-pressure geothermal fluid into the lubrication column. In particular, non-condensable gases (NCG's) present in the geothermal fluid, especially when the geothermal fluid contains a large amount of NCG's, are liable to infiltrate into the lubrication column, causing sluggish oil flow and even damage to the pump as a result of repeated cycles of bubble formation and cavitation.

It is an object of the present invention to provide an apparatus for maintaining operation of a geothermal production pump when extracting geothermal fluid having a relatively high NCG content.

Other objects and advantages of the invention will become apparent as the description proceeds.

SUMMARY

The present invention provides an apparatus for maintaining the operation of a geothermal production pump which comprises one or more impellers and a vertical line shaft for driving said one or more impellers, comprising a liquid buffer for isolating a discharge column through which pumped geothermal fluid including non-condensable gases flows from a lubrication column through which oil for lubricating one or more bearings of the line shaft flows, said liquid buffer being interposed between said discharge column and an outlet of said lubrication column to prevent infiltration of the non-condensable gases into the lubrication column.

In one aspect, the liquid buffer is defined by a cup structure which comprises an upper oil receiving section facing the lubrication column outlet, and a lower securing element related to said receiving section for defining an interior of said receiving section and for securing said cup structure to the line shaft, spent oil from the lubrication column being introducible into, and overflowable from, said oil receiving section. The spent oil that overflows from the receiving section is entrainable by the pumped geothermal fluid.

The present invention is also directed to a geothermal production pump, comprising a structure and bowl arrangement in which the cup structure and a throttle bearing (thrust bearing), lubricated by oil flowing through the lubrication column, are housed, said bowl arrangement being in fluid communication with, and being located above, a further bowl arrangement in which an uppermost impeller of said geothermal production pump is housed.

In one aspect, the flow rate of the pumped geothermal fluid through the bowl arrangement and through the further bowl in which the uppermost impeller is housed is substantially equal.

DETAILED DESCRIPTION

Figure 1:
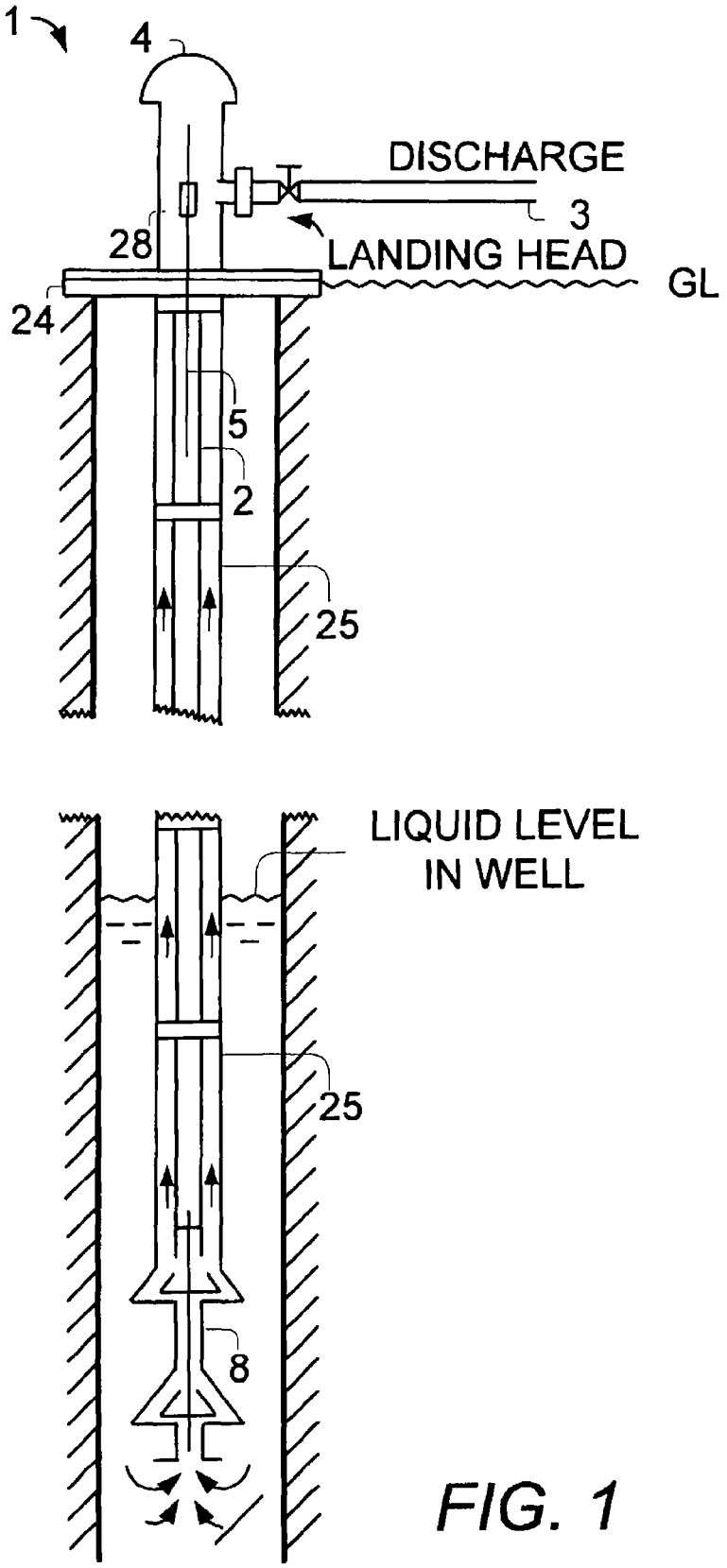
FIG. 1 is a vertical cross sectional view of a portion of a production well and pump.

Geothermal fluid extracted by a production pump 1 flows upwardly within a discharge column to ground level, for use in power production or any other suitable use (see FIG. 1). Discharge column 25 surrounds lubrication column 2 of geothermal production pump 1 within which long vertical line shaft 5 rotates transmitting torque generated by motor 4 to the production pump impellers 8. Motor 4 is supported by landing head 28, which is positioned in overlying relation to, and connected to discharge column 25. The geothermal fluid delivered upwardly by production pump 1 flows through the annulus of discharge column 25 and of landing head 28, and then exits via discharge pipe 3 connected to a fitting of landing head 28. The lubrication column 2 provides lubrication oil for bearings that support line shaft 5, and terminates after lubricating the bearing, which maintains the radial position of the line shaft 5.

Figure 2:
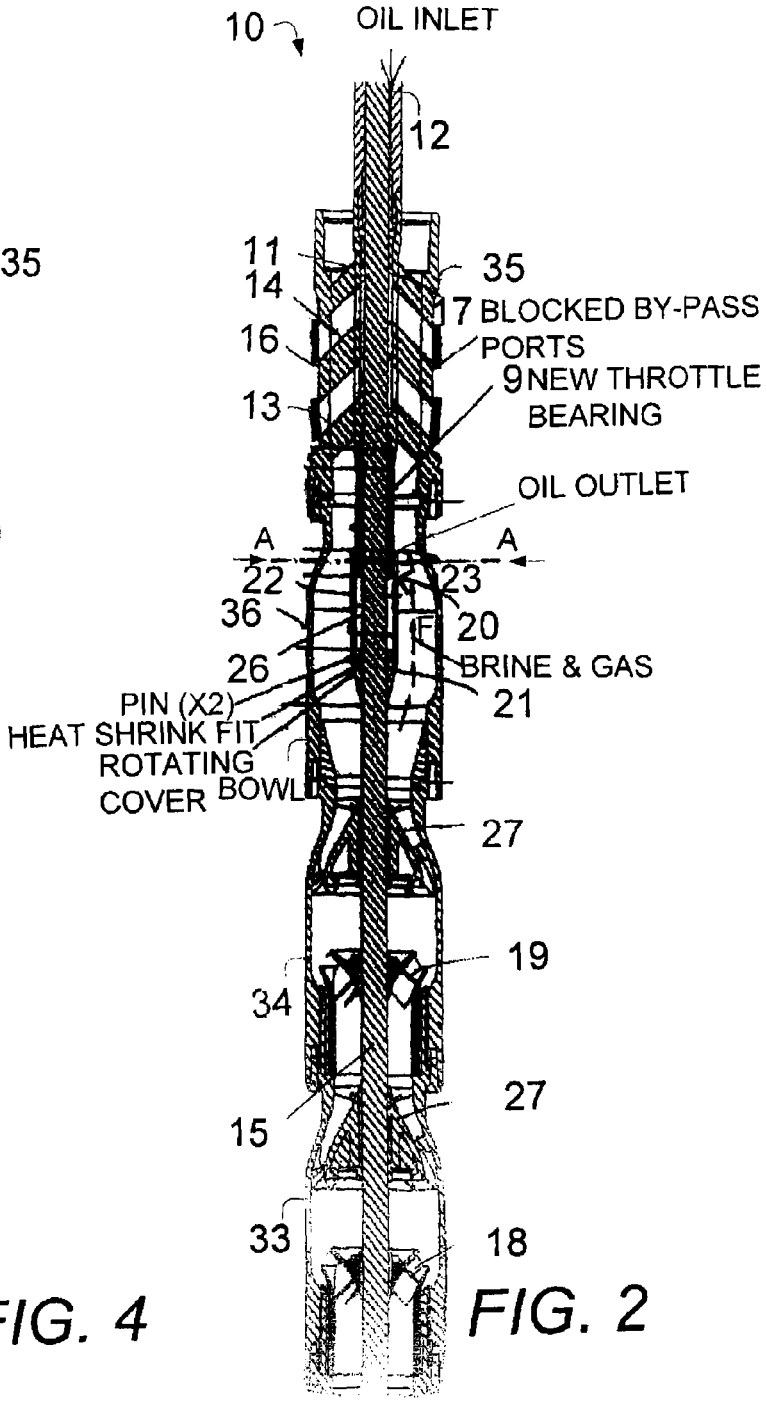
FIG. 2 is a vertical cross sectional view of a portion of a production pump, according to one embodiment of the present invention.

With respect to prior art pumps, lubricating oil can exit the bottom of lubrication column and is disposed of via channels 14 shown in FIG. 2 to bypass ports 16 (see FIG. 2), allowing the oil to be discharged into the annulus of the production well casing. As the pumped geothermal fluid which includes brine and NCG's flows adjacent the lubrication column outlet, it has been found that some NCG's infiltrate the lubrication column. The infiltrated NCG's consequently flow upwardly within the lubrication column and restrict oil flow, resulting in sluggish and non-uniform oil flow that reduces its lubricating capability. At times, the infiltrated oil cavitates and wear to the line shaft bearings is accelerated.

In the geothermal production pump of the present invention, infiltration of the NCG's to the lubrication column is prevented by providing a cup structure attached to the line shaft. Consequently, the lubrication oil exiting the bottom of the lubrication column accumulates in the cup interior and induces an upward oil flow to counteract the effect of NCG's infiltration.

FIG. 2 illustrates a vertical cross sectional view of a portion of a production pump generally designated 10, according to one embodiment of the present invention. The pumped geothermal fluid F flows upwardly within discharge column 35, which is annular in shape and surrounds line shaft 15, and is then diverted to the ground surface by an elbow or any other flow directing device (not shown).

Vertically disposed line shaft 15 of pump 10, which transmits torque from the pump motor of the head assembly, is engaged with first stage impeller 18 and second stage impeller 19, or any other number of impeller stages, and causes the same to rotate within the bowl assembly, which includes a suction bell (not shown) located at the bottom of first bowl 33, a first bowl 33 in which first stage impeller 18 is housed, a second bowl 34 in which second stage impeller 19 is housed, and spacer bowl 36 located above second stage bowl 34. During rotation of impellers 18 and 19, the momentum of the fluid to be extracted from the well in which pump 10 is disposed is increased, causing the fluid to rise through the suction bell. A diffuser 27 located above each impeller converts the tangential flow of increased pressure diverging from impellers 18 and 19 to an axial flow of fluid F rising within spacer bowl 36.

Within spacer bowl 36 is housed cup structure 20. Cup structure 20 comprises cylindrical wall 22 which is substantially coaxial with line shaft 15, and securing element 21 located below wall 22 for securing cup structure 20 to line shaft 15, preferably by a heat shrink fit. Securing element 21 may gradually taper as shown from the bottom of cylindrical wall 22 to the outer surface of line shaft 15. Cup structure 20 therefore rotates together with line shaft 15.

Throttle bearing 9 is advantageously able to be longer than the journal bearing of prior art production pumps, for increased support to line shaft 15 in the radial direction, due to the added volume afforded by spacer bowl 36. Throttle bearing 9, which prevents lateral movement of line shaft 15, is supported by a plurality of elongated retainers 13 radially extending from tube 11 and connected to lubrication column 12 in the vicinity of throttle bearing 9 to the casing of discharge column 35.

Lubrication oil pumped by a pump located at the head assembly flows downward within lubrication column 12 surrounding line shaft 15. After lubricating throttle bearing 9, the lubrication oil is discharged into the interior 26 of cup structure 20 between cylindrical wall 22 to the outer surface of line shaft 15. The discharged lubrication oil accumulates within interior 26 and eventually overflows, flowing upwardly over cup structure rim 23, which is located above the bottom surface of throttle bearing 9.

The mass of oil disposed in cup structure 20 serves as a liquid buffer between lubrication column 12 and spacer bowl 36. The pressure of the pumped geothermal fluid flowing upwardly within the discharge of spacer bowl 36 in this case is not high enough to dissolve all the NCG's that comprise the geothermal resource. In contrast to prior art production pumps which suffer from sluggish oil flow due to the infiltration of the liberated NCG's through the bottom of the lubrication column, the NCG's in the pump of the present invention are not directly exposed to the bottom of the lubrication column, but rather to the top of the oil mass overflowing rim 23. The oil near rim 23 resists the mass transport of NCG's through the cup structure interior 26 to such a degree that the pressure of the NCG's at the bottom of lubrication column 12 is no greater than, and is generally less than, the pressure of the oil flowing through the lubrication column. Accordingly, the infiltration of the NCG's into lubrication column 12 will be negligible or just about nonexistent.

The overflowing oil is entrained into the pumped high pressure geothermal fluid F and carried with the pumped geothermal fluid. Since the bowl assembly is provided with blocked bypass ports 17, or with a casing made without any bypass ports, the discharged oil is not induced outwardly from the bowl assembly into the well annulus, as has been practiced heretofore.

Figure 3:
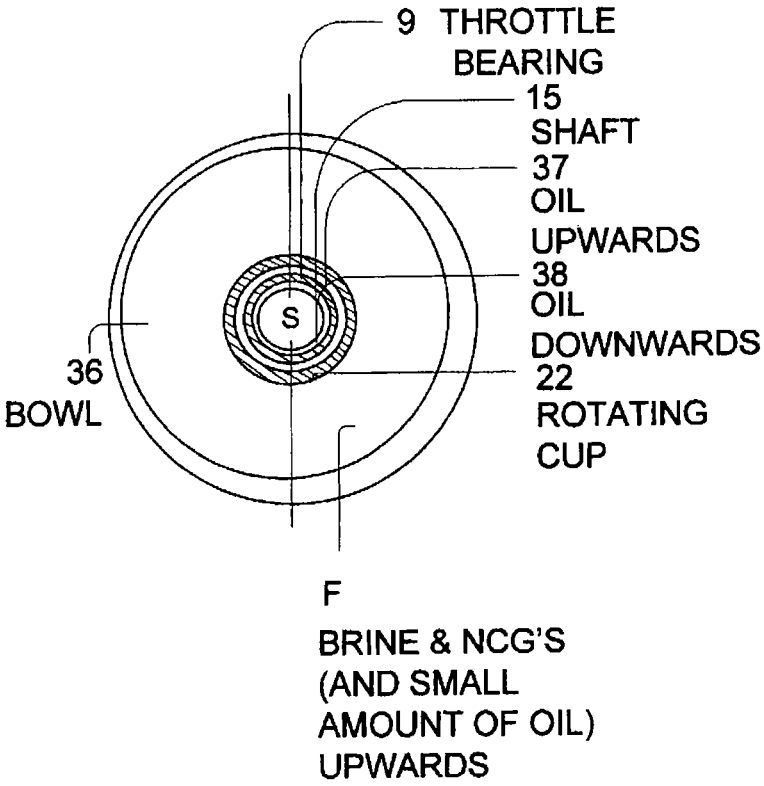
FIG. 3 is a cross section view of the pump of FIG. 1, along line A-A.

As shown in FIG. 3, the downward oil flow that overflows from the cup structure is limited by the small clearance 38 between throttle bearing 9 and line shaft 15. The flow rate of overflowing oil that is entrained in the pumped geothermal fluid may be as little as about 1-10 ppm.

Figure 4:
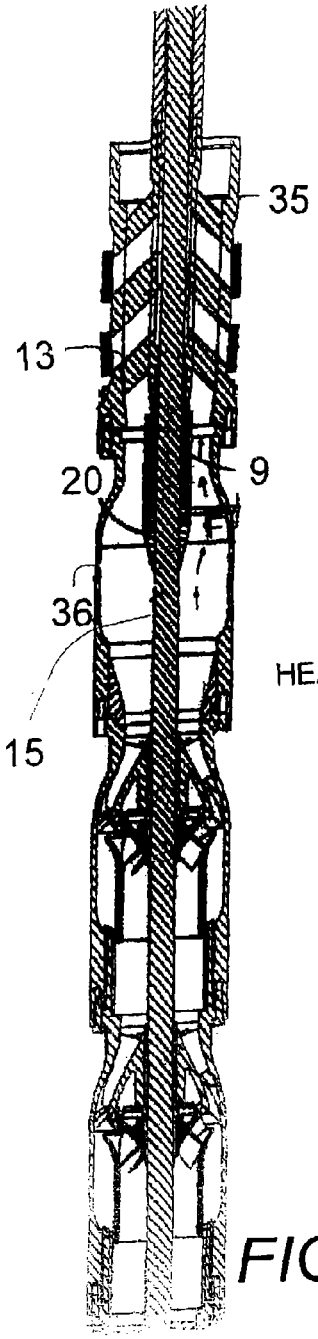
FIG. 4 is a vertical cross sectional view of a portion of the pump of FIG. 1, showing the cup structure in a raised position when the line shaft is subjected to thermal expansion.

As shown in FIG. 4, line shaft 15 is subject to thermal expansion when the hot geothermal fluid F flows through discharge column 35 and elongation due to the downward thrust. As a result of the expansion, cup structure 20 rises with respect to throttle bearing 9 and the volume of the cup structure interior becomes reduced.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. Apparatus for maintaining the operation of a geothermal production pump which comprises one or more impellers and a vertical line shaft for driving said one or more impellers, comprising:

a liquid buffer for isolating a discharge column through which pumped geothermal fluid including noncondensable gases flows from a lubrication column through which oil for lubricating one or more bearings of the line shaft flows, said liquid buffer being interposed between said discharge column and an outlet of said lubrication column to prevent infiltration of the noncondensable gases into the lubrication column, wherein the liquid buffer is defined by a cup structure which comprises an upper oil receiving section facing the lubrication column outlet, and a lower securing element related to said upper oil receiving section for defining an interior of said upper oil receiving section and for securing said cup structure to the line shaft, spent oil from the lubrication column being introducible into, and overflowable from, said upper oil receiving section, wherein a lowermost bearing of the one or most bearings is a thrust bearing, further comprising a bowl in which the cup structure and the thrust bearing are housed, said bowl being in fluid communication with, and being located above, a further bowl in which is housed an uppermost impeller.

2. The apparatus according to claim 1, wherein the liquid buffer is rotatable together with the line shaft.

3. The apparatus according to claim 1, wherein the spent oil that overflows from the receiving section is entrainable by the pumped geothermal fluid.

4. The apparatus according to claim 1, wherein the oil receiving section is a cylindrical wall which is substantially coaxial with the line shaft.

5. The apparatus according to claim 1, wherein the securing element is adapted to secure the receiving section to the line shaft by a heat shrink fit.

6. The apparatus according to claim 1, wherein a rim of the receiving section over which the spent oil is overflowable is located above a lowermost surface of the thrust bearing.

7. The pump according to claim 1, wherein said bowl, in which the cup structure and the thrust bearing are housed, is similarly configured to said further bowl in which the uppermost impeller is housed with the exception that all diffusers and all impellers are removed from the bowl.

8. The pump according to claim 7, wherein the pumped geothermal fluid pumped through said bowl in which the cup structure and the thrust bearing are housed is pumped through said further bowl in which the uppermost impeller is housed.

9. The pump according to claim 1, wherein bypass ports are associated with said bowl and said further bowl, and all bypass ports associated with said bowl and said further bowl are blocked.

* * * * *